US005448133A

United States Patent [19]

Ise

[11] Patent Number: 5,448,133

[45] Date of Patent: Sep. 5, 1995

[54] FLAT PANEL FIELD EMISSION DISPLAY DEVICE WITH A REFLECTOR LAYER

[75] Inventor: Tomokazu Ise, Abiko, Japan

[73] Assignee: Sharp Kabushiki Kaisha, Osaka, Japan

[21] Appl. No.: 295,358

[22] Filed: Aug. 24, 1994

Related U.S. Application Data

[63] Continuation of Ser. No. 975,912, Nov. 16, 1992, abandoned.

[30] Foreign Application Priority Data

Dec. 27, 1991 [JP] Japan ..... 3-347210

[51] Int. Cl.[6] ..... H01J 63/04

[52] U.S. Cl. ..... 313/497; 313/308; 313/309; 313/336; 313/351; 315/169.4

[58] Field of Search ..... 313/495, 496, 497, 309, 313/336, 351, 113, 369, 308; 315/169.4; 345/47, 75

[56] References Cited

U.S. PATENT DOCUMENTS

| | | | |
|---|---|---|---|
| B 453,031 | 3/1976 | Fukase et al. | 313/309 |
| 3,594,583 | 7/1971 | Sheldon | 313/369 |
| 4,845,407 | 7/1989 | Ikuta | 313/496 |
| 4,857,799 | 8/1989 | Spindt et al. | 313/495 |
| 4,924,141 | 5/1990 | Taubner et al. | 313/113 |
| 4,935,665 | 6/1990 | Murata | 313/113 |

OTHER PUBLICATIONS

R. Meyer et al., "Microtips Fluorescent Display", Japan Display 86, pp. 512–515.

Japanese Patent Application Laying Open (Kokai) No. 62-172631, laid open on Jul. 29, 1987.

Ivor Brodie, "Advanced Technology: flat cold-cathode CRTs", 8271 *Information Display* 5 (1989) Jan., No. 1, pp. 17–19.

*Primary Examiner*—Anita Pellman Gross
*Assistant Examiner*—Walter Malinowski
*Attorney, Agent, or Firm*—David G. Conlin; Peter F. Corless

[57] ABSTRACT

A flat panel display device comprises an anode electrode, a fluorescent layer formed on the anode electrode, a cathode electrode having a plurality of cold cathodes, a gate electrode spaced from and electrically insulated from the cathode electrode for triggering emission of electrons by the cold cathodes, and a light-reflecting layer formed on or above the gate electrode face to face with the fluorescent layer.

7 Claims, 9 Drawing Sheets

FLAT PANEL FIELD EMISSION DISPLAY DEVICE WITH A REFLECTOR LAYER

This is a continuation of application Ser. No. 07/975,912 filed on Nov. 16, 1992, now abandoned.

BACKGROUND OF THE INVENTION

1. Field of the Invention

The present invention relates to a flat panel display device having an array of cold cathodes each served as an electron source.

2. Description of the Related Art

In recent days, the study and development of a flat panel display device is being active. As examples of such a display device, a liquid crystal display (LCD), an electroluminescent display (ELD) and a light-emitting diode display (LED) are now made commercially available. Those displays are, however, inferior to a cathode-ray tube (CRT) with respect to luminance of emitted light, resolution and color. Hence, several kinds of thin CRTs have been developed. Those thin CRTs are largely grouped into ones having dot electron sources like the normal CRT, ones having a plurality of linear cathodes, and ones having cathodes extending on the overall fluorescent surface. Concretely, an electron multiplication type CRT, a horizontal address and vertical electrostatic deflection type CRT, a MSD (Matsushita Denki) type CRT, and a flat CRT are made commercially available. In particular, the MDS type CRT is made thinner than the other CRTs so that the 10-inch CRT have a depth of 9.9 cm.

All the CRTs described above contain a fluorescent material coated on their display surface as a luminophore material. To enhance the luminance, in general, there is coated an aluminum (Al) thin film having a high light-reflecting factor and electron permeability on the opposite side to the side of the fluorescent layer viewed from the user. The coat of this film is referred to as an aluminizing or metal-backing method.

However, even such a high-performance thin CRT becomes critical in coping with the current increase of used information or the social phenomenon where each person may have his or her portable TV. The demands for lighter, thinner and shorter image display device have rapidly risen. In particular, a great remark is placed on an image display device where field-emission type cold-cathode microguns are disposed in a matrix. As this type of image display device, "Microtips Fluorescent-Display" by R. Heyer, et. al. has been published in the Japan Display 1986 Conference. The microgun is made of a molybdenum cold-cathode tip. An electric field takes place between the cold-cathode tip and a gate electrode located adjacent to the top of the tip, so that electrons are emitted through the effect of the electric field. The distance between an anode electrode surface made of a luminophore material and the gate electrode is about 100 μm. It means that the manufacture of a super thin and high-definition image device is made possible if it is used. This device can be used for a large flat display TV or a display provided in a portable electronic equipment.

To progress the study and development of the application of a flat panel display device having electric-field emission type cold-cathode microguns into the portable electronic equipment, it is necessary to keep its operating voltage as low as possible. The reduction of the voltage can reduce the size of battery and this reduction of the size results in making it for the electronic equipment to be more portable. To lower the operating voltage, it is necessary to lower a threshold voltage between the cathode electrode and the gate electrode, the threshold voltage being a critical voltage for emitting electrons through the effect of an electric field. Currently, the threshold voltage is about 50 V and the smaller operating voltage is 80 V between the cathode electrode and the gate electrode and about 400 V between the cathode electrode and the anode electrode. The operating voltage is now being acceleratingly ameliorated. It will be several tens V some years later.

However, the energy of electrons colliding with the fluorescent material coated on the anode electrode surface and the luminance of the fluorescent material are made lower as the operating voltage is getting lower. This results in lowering the luminance of the displayed image, thereby making the image quality worse.

To overcome this shortcoming, it is possible to divert the metal-backing structure which has been used in the thin type thin CRTs mentioned above. In a case that a metal back structure (Al film) is used in the flat panel display device having microguns of electric field type cold-cathodes, the emitted electrons pass through the Al film into the fluorescent layer surface, because the cathodes are located on the opposite side to the display surface. Some of the emitted electrons are absorbed in the Al film and the remaining of the electrons reach the fluorescent layer. In general, the Al film is made as thick as about 0.2 μm by considering prevention of ion penetration and oxidation in the working process. If the Al film having a thickness of about 0.2 μm is used, to enhance a penetration factor of electron energy to 50% or higher, the electrons need to have energy of about 7 KeV or more. If the Al film thickness is about 0.05 μm, the electrons need to have energy of about 3.5 Kev or more. The current CRT device may supply such high energy to the electrons. However, the flat panel display device to be applied to the portable electronic equipment disables to supply so high energy.

SUMMARY OF THE INVENTION

It is therefore an object of the present invention to provide a flat panel display device which can be used for a portable electronic equipment.

In carrying out the object, a flat panel display device according to the invention comprises an anode electrode, a fluorescent layer formed on the anode electrode, a cathode electrode having a plurality of cold cathodes, a gate electrode spaced from and electrically insulated from the cathode electrode for triggering emission of electrons by the cold cathodes, and a light-reflecting layer formed on or above the gate electrode face to face with the fluorescent layer.

When a predetermined voltage is applied between the cathode electrode and the gate electrode for triggering emission of electrons by the cold cathodes and between the cathode electrode and the anode electrode, electrons are emitted from the tips of the cold cathodes based on the principle of electric field emission. Those electrons are accelerated to the anode so that the electrons may collide with the fluorescent layer for emitting light. In this case, the emitted light is scattered to the opposite side of the fluorescent layer to the side viewed by the user, that is, to the cold cathode and the gate electrode. To overcome the disadvantage due to the scattered light, a light-reflecting film is formed on the opposite surface to the fluorescent layer surface of the gate electrode so that the incident ray is allowed to be reflected on the user-viewed surface.

In a preferred embodiment, the image display device is provided with the light-reflecting film which has a surface sloped against the surface of the fluorescent layer. The light-reflecting film serves to concentrate the reflected light on a point near the luminous point of the luminescent layer.

This light-reflecting film makes it possible to enhance the luminance of the displayed image by reflecting the scattered light incident to the opposite surface to the luminescent layer of the gate electrode onto the user-vidwed surface. This can compensate for the reduction of the image luminance resulting from the lowering of operating voltage of the electronic equipment. This image display device can be applied to the portable electronic equipment. Further, by sloping the light-reflecting film, the reflected light is concentrated for improving a crosstalk due to the reflected light.

The image display device may have the light-reflecting film which is arranged to have any one of a single-layered structure of a metal film or a dielectric film, a multilayered structure of two or more dielectric films having respective indexes of refraction, and another multilayered structure of a dielectric film and a metallic film.

Further objects and advantages of the present invention will be apparent from the following description of the preferred embodiments of the invention as illustrated in the accompanying drawings.

DESCRIPTION OF THE PREFERRED EMBODIMENTS

Figure 1:
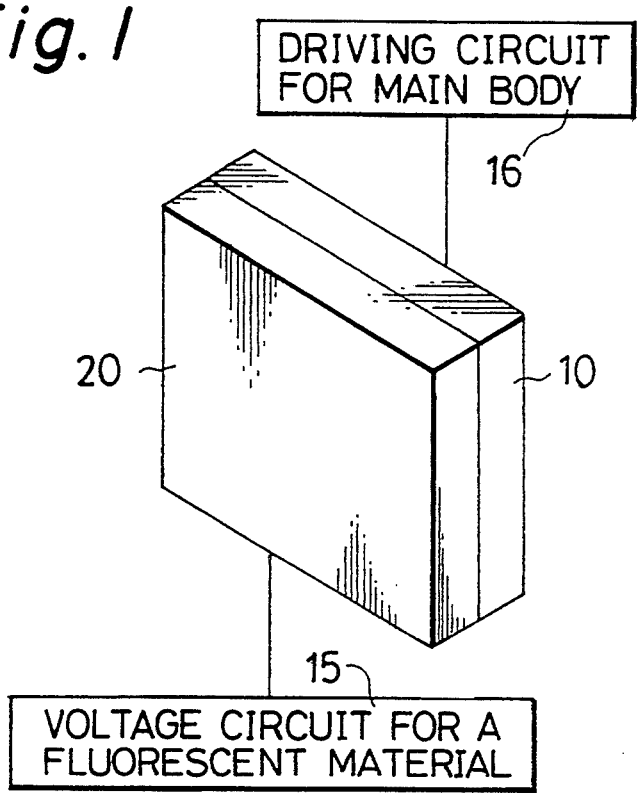
FIG. 1 is a perspective view schematically showing a flat panel display device according to an embodiment of the invention.

Herein, the description will be directed to an embodiment of the invention as referring to the drawings.

Figure 2:
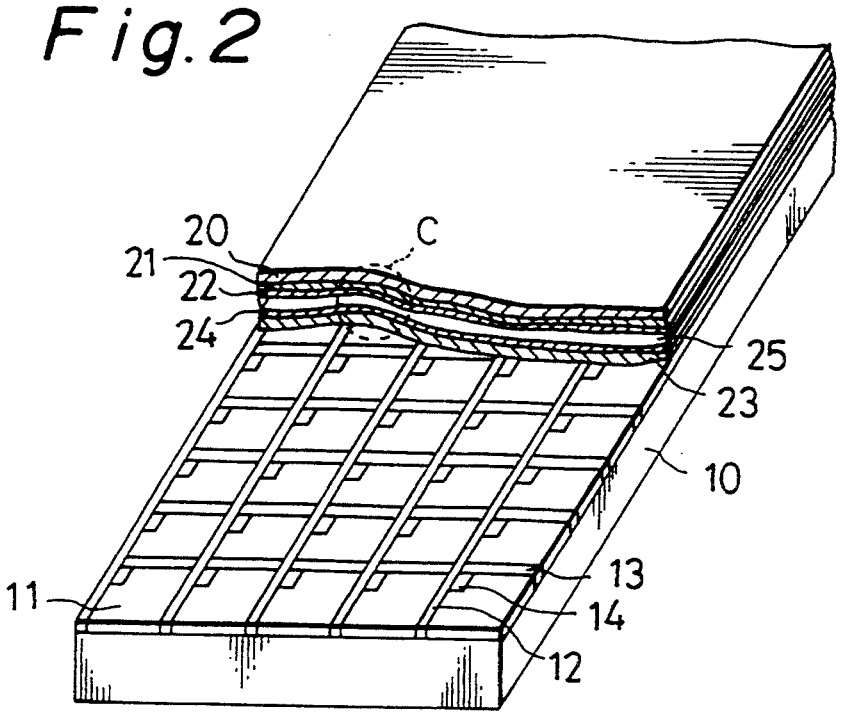
FIG. 2 is a perspective view schematically showing the apparent look of the flat panel display device shown in FIG. 1.

FIG. 1 is a perspective view schematically showing an apparent look of the flat panel display device. FIG. 2 is a perspective view schematically showing the structure of a flat panel display device according to an embodiment of the invention.

As shown in FIG. 1, the flat panel display device includes a vacuum enclosure having a face plate 20 and a back-supporting plate 10. The electron-emission structure such as a field-emission type cold cathode is provided within the vacuum enclosure. A numeral 15 denotes a circuit for feeding a voltage to a fluorescent material and a numeral 16 denotes a circuit for driving a main body having an array of cold cathodes.

As shown in FIG. 2, the flat panel display is provided with an array of cold-cathode electrodes 11 arranged as an X-Y matrix. A numeral 21 denotes an anode electrode layer which is consists of a transparent conductive layer. The cathode electrode 11 is formed within each area partitioned by scan lines 12 and signal lines 13 so as to address each pixel of a fluorescent layer 22 laminated on a face plate 20 through the anode electrode layer 21. The adjacent cathode electrodes 11 are electrically insulated from each other. Each cathode electrode 11 is adapted to be driven by an X-Y matrix having the scan lines and the signal lines crossed with each other, which have been traditionally used in the liquid crystal display. At each cross point of one scan line and one signal line, a thin film transistor (TFT) 14 is located. This TFT 14 is made of amorphous silicon (a-Si) and serves to control voltages applied between a gate electrode involved in a electron-emission structure 23 and the cathode electrode 11 corresponding to each pixel and between the cathode electrode 11 and the anode electrode layer 21 having the fluorescent layer 22 coated thereon, respectively. The electron-emission structure 23 includes the cold-cathode array (cathode array), the electrically-insulating layer, and the gate electrode. A numeral 24 denotes a light-reflecting film, and a numeral 25 denotes a vacuum area. The components 23 to 25 will be described in detail later.

In this embodiment, the TFT 14 employs a back-stagerred structure in which a gate wire serves as a scan line and a signal line serves both a source and a drain electrodes. Though the TFT 14 is cubic, herein, it is leveled so as to match to the structure of the cathode electrode 11 for the practical use. The structure of the TFT 14 is not descriptive herein, because it has been well known.

Figure 3:
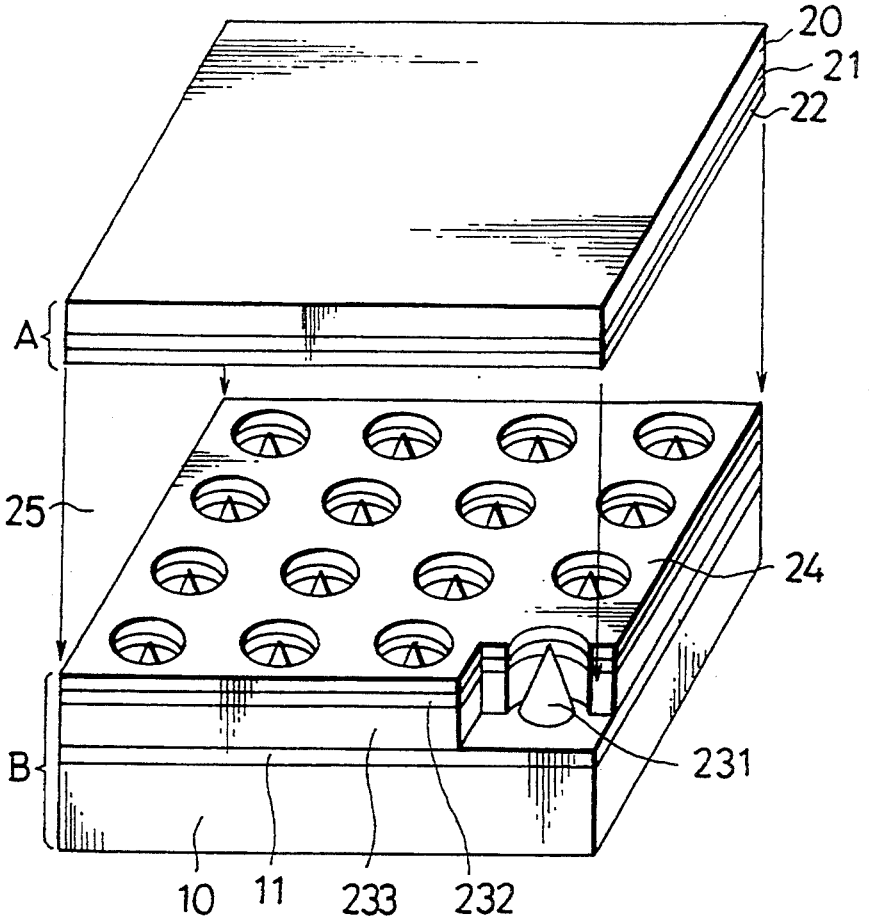
FIG. 3 is an expanded perspective view showing a C section shown in FIG. 2.
Figure 4:
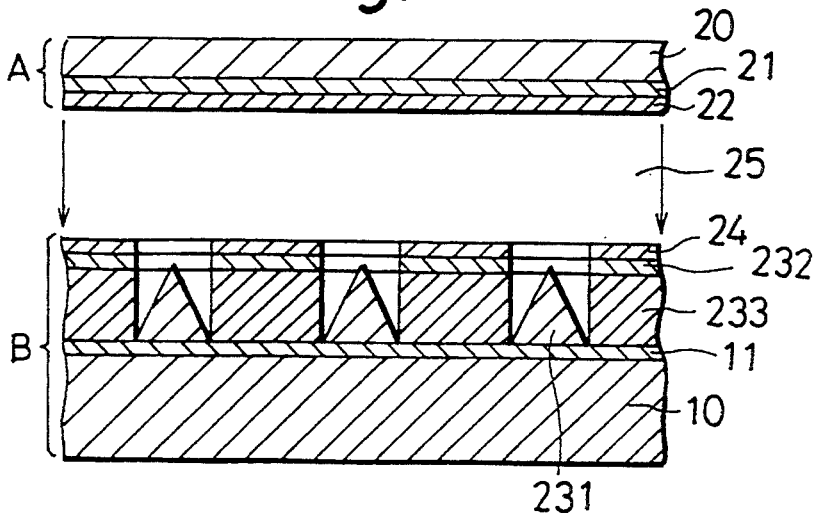
FIG. 4 is an expanded perspective view showing a C section shown in FIG. 2.

FIG. 3 is an expanded perspective view showing a C section enclosed by a dotted line of FIG. 2. FIG. 4 is an expanded sectional view showing an essential part shown in FIG. 3.

In FIG. 3, a section A looks like being separated from a section B. In actual, the sections A and B and a spacer located therebetween establish the vacuum area 25. Each pixel corresponding to one cathode electrode 11 is provided with a plurality of conical cold-cathodes 231, which serves to emit electrons from its tip. The set of cold-cathodes 231 is referred to as a cathode array. The cathode array is partitioned so as to correspond to the cathode electrode 11 partitioned likewise and is formed on the corresponding cathode electrode area. The adjacent cathode arrays are electrically insulated from each other. A gate electrode layer 232 for picking up an electron beam is formed on the cathode electrode 11 through an electrically insulating layer 233. Further, a light-reflecting film 24 is formed on the gate electrode layer 232.

By applying a voltage between the cathode electrode 11 and the gate electrode 232, a strong electric field is induced on the cold-cathode 231, in particular, its tip through the field effect so that electrons are emitted from the tip of the cold-cathode 231. The emitted electrons are accelerated by the anode electrode 21 and rush onto the surface of the fluorescent layer 22 formed on the anode electrode layer 21. The anode electrode 21 keeps an active state by applying a voltage in advance.

The rushed electrons generate pairs of electron and hole in the fluorescent layer 22. In theory, the transition of the generated electrons brings about light. Hence, to produce light from the rushed electrons, the rushed electrons have to keep higher energy than the energy for generating the pairs of electrons and holes. That is, the voltage applied between tile gate electrode 232 and the anode electrode 21 needs to be a high value enough to give the rushed electrons higher energy than the energy for generating the pairs of electrons and holes. The luminance of the fluorescent layer 22 is, in principle, in proportional to the energy of the rushed electrons and the luminous efficiency of the fluorescent layer 22.

As such, the light emitted to the opposite side to the user-viewed side of the fluorescent layer, that is, the light scattered toward the cold-cathode and the electrode for picking up the electron beam, in particular, the light incident to the opposite surface of the gate electrode to the fluorescent layer is allowed to be reflected on the user-viewed side. This results in enhancing the luminance of the display image. The enhancement of the luminance due to this arrangement can compensate for lowering of a luminance of an image resulting from lowering of an operating voltage. Herein, the user-viewed side of the fluorescent layer means the image-displaying side where a user can watch an image.

Turning to FIG. 5, the description will be directed to the process for forming the cold-cathode 231, the electrically insulating layer 233, the gate electrode 232, and the light-reflecting film 24 included in the B section of FIG. 3.

Figure 5A:
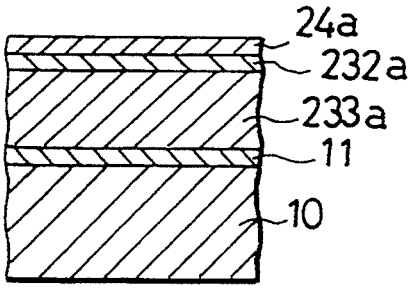
FIGS. 5*a*–5*f* are sectional views for describing a process for producing a cathode electrode, a cold-cathode, an electrically insulating layer, a gate electrode, and a -light-reflecting layer included in a B section shown in FIG. 4.

A glass substrate with a thickness of 1.2 mm is used as a back-supporting plate 10. On the glass substrate, there are sequentially laminated a Mo (Molybdenum) layer of 0.5 μm, an $SiO_2$ layer 233*a* of 1 μm, another Mo layer 232*a* of 0.3 μm, and an Ag (Silver) layer 24*a* of 0.1 μm. The first Mo layer serves as the cathode electrode layer 11. The $SiO_2$ layer 233*a* serves as the electrically insulating layer 233. The second Mo layer 232*a* serves as the gate electrode 232. The Ag layer 24*a* serves as the light-reflecting film 24. Those layers are evaporated by an electron beam evaporating device. The resulting structure is shown in FIG. 5*a*.

Figure 5D:
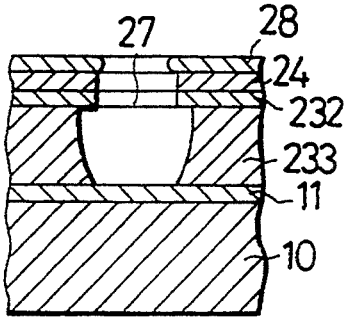
Figure 5B:
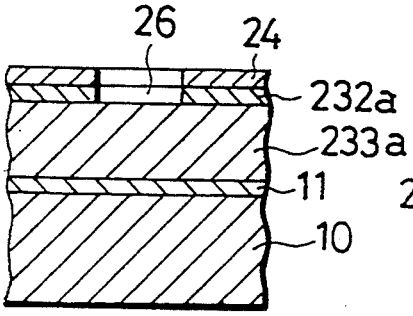

Next, after patterning the lamination with a photo mask, a hole 26 with a diameter of about 1.2 μm is formed through the Mo layer 232*a* and the Ag layer 24*a* by means of a RIE (Reactive Ion Etching) device. The resulting structure is shown in FIG. 5*b*. The depth of the hole 26 reaches the surface of the $SiO_2$ layer 233*a*.

Figure 5E:
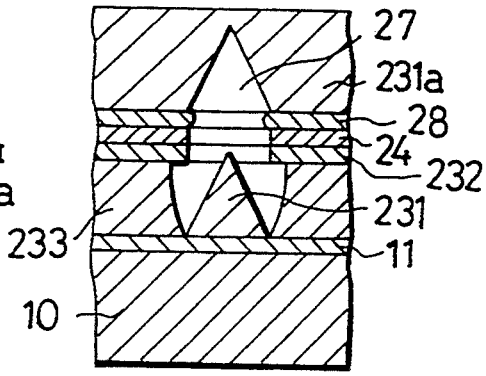
Figure 5C:
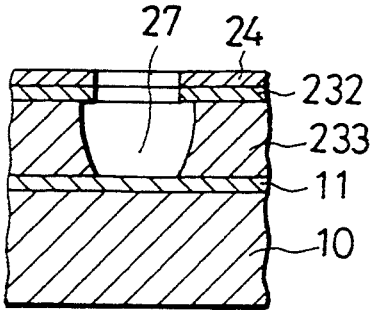

A hole 27 is formed through the $SiO_2$ layer 233 forming the bottom of the hole 26. The hole 27 reaches the surface of the cathode electrode layer 11. The resulting structure is shown in FIG. 5*c*. The hole of the gate electrode layer 232 is undercut by about 0.1 to 0.3 μm.

After coating a resist 28 on the light-reflecting film, a concentric hole with the hole 27 is formed through the resist film 28 by means of a lithography device. The resulting structure is shown in FIG. 5*d*. Herein, the thickness of the resist film 28 is 0.4 μm and the diameter of the hole is 0.8 μm.

By means of the electron beam evaporating device, molybdenum (Mo) is evaporated. Mo is deposited on the resist 28 toward the film thickness and the hole diameter of the Mo film is made gradually smaller toward the hole surface. Finally, the hole 27 is closed. In this step, the conical cold-cathode 231 is formed on the surface of the cathode electrode layer 11 forming the bottom of the hole 27. The resulting structure is shown in FIG. 5*e*. The height of the cold cathode 231 is adjusted so that the tip of the cathode 281 may not go beyond the gate electrode layer 232.

Figure 5F:
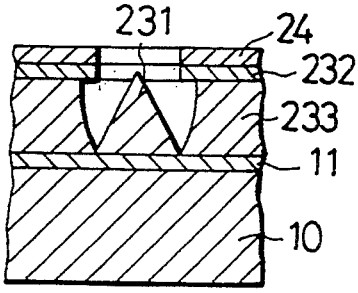

Then, the removal of the resist layer 28 by a wet etching technique results in forming the B section shown in FIG. 4. In the B section shown in FIG. 4, the electrically insulating layer 233 in the hole of the gate electrode layer 282 is not undercut for the purpose of exemplarily illustrating the structure. In actual, as shown in FIG. 5*f*, it is undercut.

Next, the description will be directed to another process for producing the cold-cathode 231, the electrically insulating layer 233, the gate electrode 232, and the light-reflecting film 24 included in the B section shown in FIG. 3 as referring to FIG. 6.

As shown in FIG. 6, as a back-supporting plate 10, a glass substrate with a thickness of 1.2 mm is used. On the glass substrate, there are sequentially laminated a Mo (Molybdenum) layer 11 of 0.5 μm, an $SiO_2$ layer 233*b* of 1 μm, another Mo layer 232*b* of 0.3 μm, an Ag (Silver) layer 24*b* of 0.1 μm, and a resist layer 29 of 0.8 μm. The first Mo layer serves as the cathode electrode layer 11. The $SiO_2$ layer 233*b* serves as the electrically insulating layer 233. The second Mo layer 232*b* serves as the gate electrode 232. The Ag layer 24*b* serves as the light-reflecting film 24. The resist layer 29 serves as patterning the laminations. Those layers are evaporated by an electron beam evaporating device. The resulting structure is shown in FIG. 6*a*.

Figure 6A:
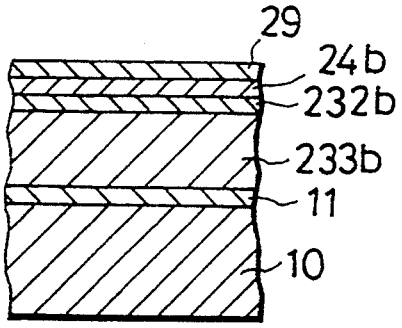
FIG. 6 is a sectional view for describing a process for producing a cathode electrode, a cold-cathode, an electrically insulating layer, a gate electrode, and a light-reflecting layer included in a B section shown in FIG. 4.
Figure 6D:
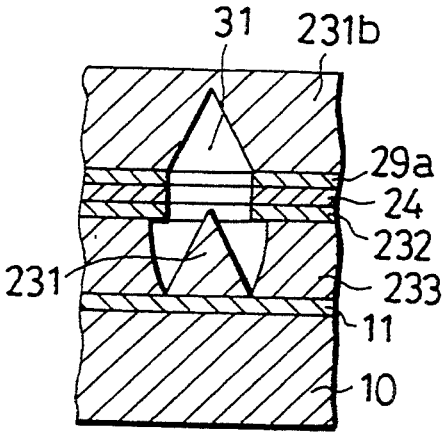
Figure 6B:
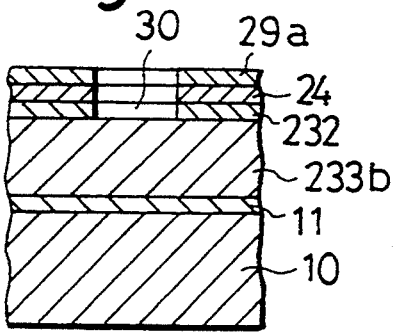

Next, after patterning the lamination with a photo mask, a hole 30 with a diameter of about 0.8 μm is formed through the Mo layer 232*b* and the Ag layer 24*b* by means of a RIE (Reactive Ion Etching) device. The resulting structure is shown in FIG. 6*b*. The depth of the hole 30 reaches the surface of the $SiO_2$ layer 233*b*.

Figure 6E:
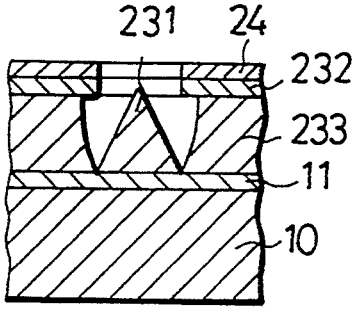
Figure 6C:
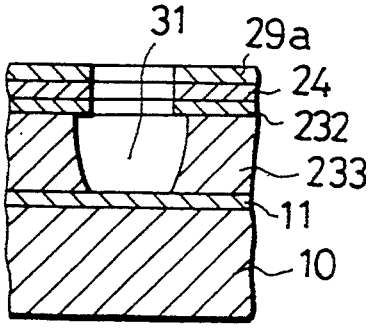

A hole 31 is formed through the $SiO_2$ layer 233*b* forming the bottom of the hole 30. The hole 31 reaches the surface of the cathode electrode layer 11. The resulting structure is shown in FIG. 6*c*. The hole of the gate electrode layer 232 is undercut by about 0.1 to 0.3 μm.

By means of the electron beam evaporating device, molybdenum (Mo) is evaporated. In this case, Mo is deposited on the resist 29*a* toward the film thickness and toward the hole surface. As such, the hole diameter of the Mo film is made gradually smaller and the Mo layer 231*b* is deposited on the resist 29*a*. Finally, the hole 31 is closed. In this step, a conical cold cathode 231 is formed on the surface of the cathode electrode layer 11 forming the bottom of the hole 31. The resulting structure is shown in FIG. 6*d*. The height of the coldcathode 231 is adjusted so that the tip of the cathode 231 may not go beyond the gate electrode layer 232.

Then, the removal of the resist layer 29a by a wet etching technique results in forming the B section shown in FIG. 4. In the B section shown in FIG. 4, the electrically insulating layer 233 in the hole of the gate electrode layer 232 is not undercut for the purpose of exemplarily illustrating the structure. In actual, as shown in FIG. 6e, it is undercut.

The molybdenum (Mo) used for making the electrodes is generally well known in the field of this art, because it is superior in thermal and mechanical strength. As another material, tungsten (W) or tantalum (Ta) may be used. In addition to those metals, a compound such as metallic nitride or metallic carbide may be used. As a material for making the light-reflecting film, aluminum (Al), gold (Au) or rhodium (Rh) may be used. Herein, the electrically insulating layer is made of $SiO_2$, though, its material is not limited to it if it is superior in the insulating characteristic. Beside, it is possible to form a buffer layer, an insulating layer, and a positioning layer with the fluorescent layer surface between the gate electrode layer and the light-reflecting film. The producing method may be suitably variable depending on the used materials and devices. The method described herein is just one example.

Next, the process for producing the A section shown in FIG. 4 will be described. As a face plate 20, a transparent glass substrate with a thickness of 1.1 mm is used. To form a transparent conductive film 21 on the glass substrate, it is possible to use In-Sn-O(ITO) or $SnO_2$ as a main material. The thickness of the film 21 is about 0.25 μm in this embodiment. The forming method employs a sputtering with an oxide as a target or a reactive sputtering with an In-Sn alloy or Sn as a metal target. As a material of the fluorescent layer 22, ZnO:Zn is used, which has the highest luminous efficiency of about 10 lm/W in a room temperature when the low-speed excitation of an electron line takes place. The thickness of the layer 22 is in the range of 0.05 to 1.2 μm for a trial. In this embodiment, it is defined as 0.3 μm. The producing method employs the electron beam evaporating method. After forming the fluorescent layer 22 in a ground temperature of 200° C., the heat treatment is carried out on the layer in vacuum (about $10^{-4}$ Pa) at 550° C. The treatment time is one hour. As an evaporating source, a sinter of ZnO and Zn is used, in which the density of Zn is adjusted to have a suitable value.

It is estimated that the energy gap of this fluorescent layer is about 3.26 eV and the Fermi level is about 0.04 eV under the conductive band. The threshold value of the energy for generating pairs of electron and hole is about 7.9 eV. Hence, to make the layer luminous, it is necessary to provide the emitted electrons with energy of at least 4.68 eV.

By jointing in vacuum the A section and the B section produced by the above methods as shown in FIG. 4 with a spacer located therebetween (vacuum: $1\times10^{-6}$ Torr), it is possible to produce the flat panel display device.

In the flat panel display device manufactured in this embodiment, the thickness of the display is about 2.4 mm and the display dimension is $110\times90$ mm$^2$ (corresponding to 6-inch display). The number of pixels included in the display is $256\times256$. The number of the convex electron emission sources included in one pixel is 1815 ($33\times55$). As the operating characteristics, when the voltage between the cathode electrode and the anode electrode is about 100 V, it was found that the luminance of the image is 260 cd/m$^2$. The screen luminance is about 1.3 times as high as the known structure having no light-reflecting film on the gate electrode layer.

In this embodiment, ZnO:Zn is used as a fluorescent layer. It is well known that three primary colors of red, blue and green are suitably fixed on the material for implementing the color display. To drive the cathode electrode, the TFT active matrix is used herein. But, of course, another driving technique may be used. In addition, the dimensions described above may be changed depending on the used materials and techniques.

As the light-reflecting film, in addition to the metal film, it is effective on reflecting light to have a lamination film of dielectrics having respective indexes of refraction or a lamination film of a metal film and a dielectric film. In this case, the lamination structure can be suitably designed for the purpose of increasing the reflected light intensity and reflecting light of a selective wavelength.

Figure 7:
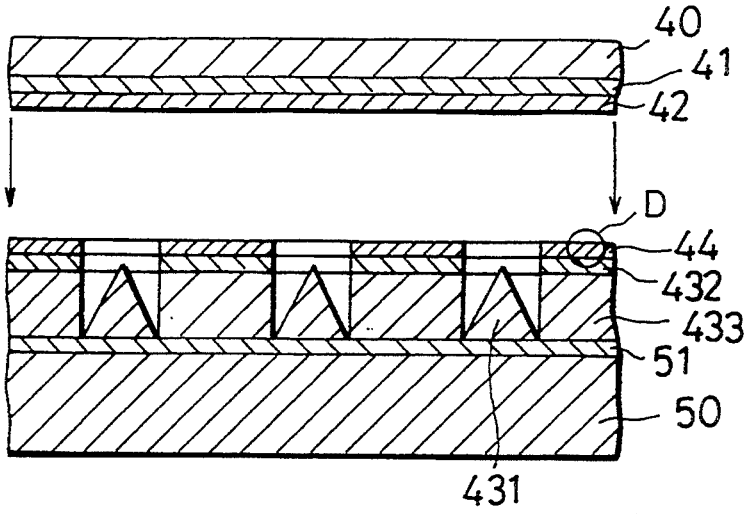
FIG. 7 is a sectional view showing the internal structure of the thin film image display device according to another embodiment of the invention.
Figure 8:
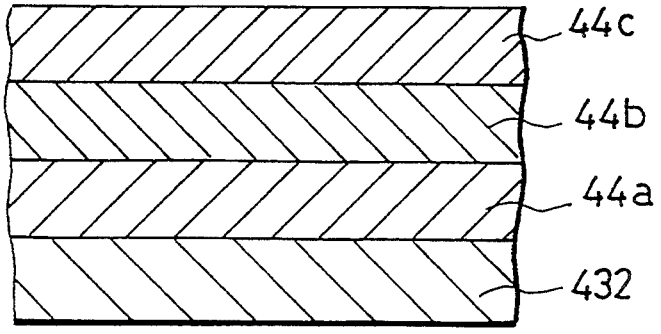
FIG. 8 is an expanded sectional view showing a D section shown in FIG. 7.
Figure 9:
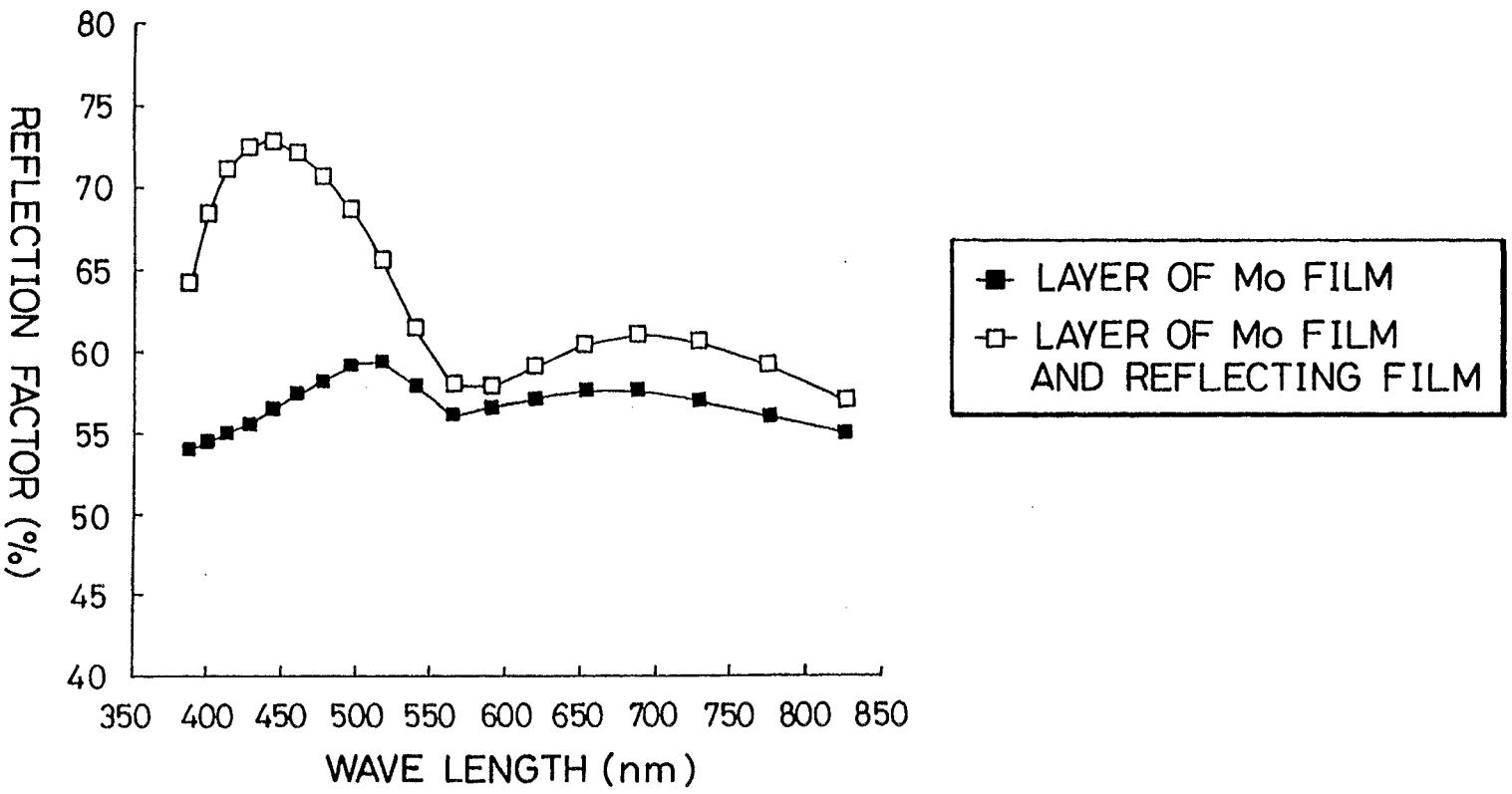
FIG. 9 is a graph showing a performance when using the laminating structure having dielectrics as a light-reflecting layer.

Next, the description will be directed to the multilayered structure consisting of dielectrics as a light-reflecting film. FIG. 7 is a sectional view showing the structure. FIG. 8 is an expanded view showing a D section shown in FIG. 7. Like the embodiment shown in FIG. 4, the light-reflecting film 44 employs a multilayered structure consisting of three dielectric layers, the detail of which will be shown in FIG. 8. On the surface of the gate electrode 432 made of an Mo film, there are sequentially laminated an $SiO_2$ film 44a of 74 nm, a $TiO_2$ film 44b of 63 nm, and an $SiO_2$ film 44c of 99 nm. The lamination of the films composes a light-reflecting film for selecting the wavelength of the reflected light. The performance (reflective factor against wavelength) of the light-reflecting film 44 having such a dielectric multilayered structure is shown in FIG. 9. In the graph of FIG. 9, black squares indicate the performance when using only the Mo film, while white squares indicate the performance when using the light-reflecting film on the Mo film. The provision of the light-reflecting film results in enhancing the reflective factor in the range of visible light, in particular, selectively enhancing the reflective factor of a blue wavelength area (around 480 nm) where the luminous efficiency of the fluorescent material drops, thereby making it possible to correct the luminance.

As another dielectric candidate, those materials may be referred such as ZnS, $WO_3$, SiO, $AlO_3$, $CaF_2$, $MgF_2$, $Si_3N_4$, $SnO_2$, and $In_2O_3$.

Figure 10:
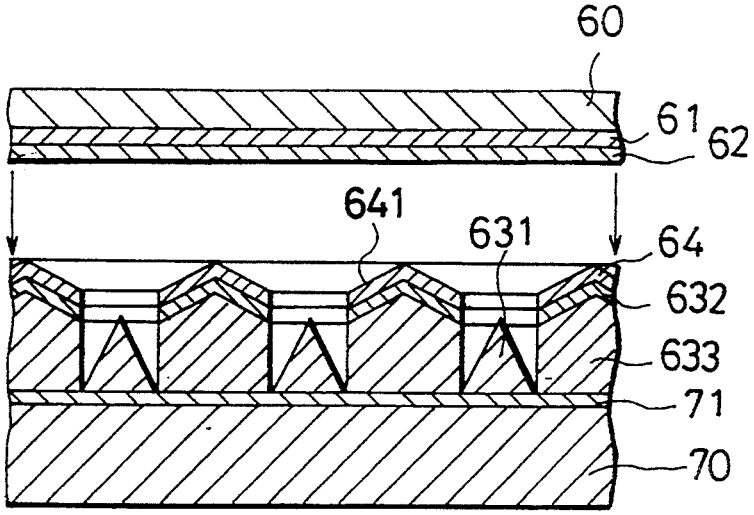
FIG. 10 is a sectional view showing the internal structure of a flat panel display device according to another embodiment of the invention.
Figure 11:
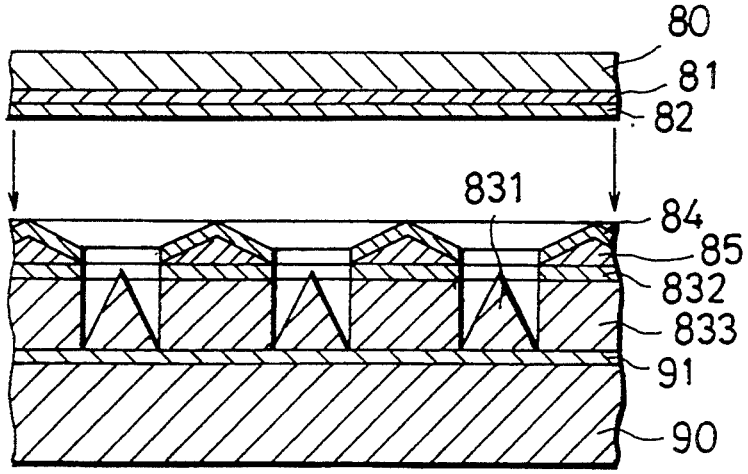
FIG. 11 is a sectional view showing the internal structure of a flat panel display device according to another embodiment of the invention.

When reflecting the light reflected from the fluorescent layer toward the fluorescent layer, for the purpose of focusing the reflected light around the luminous spot of the fluorescent layer, the inventors of the present application have developed the sloped light-reflecting film. FIGS. 10 and 11 are sectional views showing a field-emission type electron tube according to this embodiment, in which a conical light-reflecting film is deposited on the gate electrode layer around the cold-cathode.

In the structure shown in FIG. 10, after making the gate film formed on the electrically insulating layer 633 having a triangle cross section, the gate electrode layer 632 and the light-reflecting film 64 are sequentially laminated on the insulating layer 633. The light-reflecting film 64 is provided with a plurality of cone-shaped surfaces 641 each sloped downward a hole in which one of the cold cathodes 631 is disposed.

In the structure shown in FIG. 11, after producing a conical base 85 on the gate electrode layer 822, the light-reflecting film 84 is formed thereon. The light-reflecting film 84 is provided with a plurality of cone-shaped surfaces each sloped toward a hole in which one of the cold cathodes 831 is disposed. The experiment indicated that both of the structures shown in FIGS. 10 and 11 may offer the same effect in terms with light concentration, thereby improving the crosstalk due to the reflected light.

Figure 12:
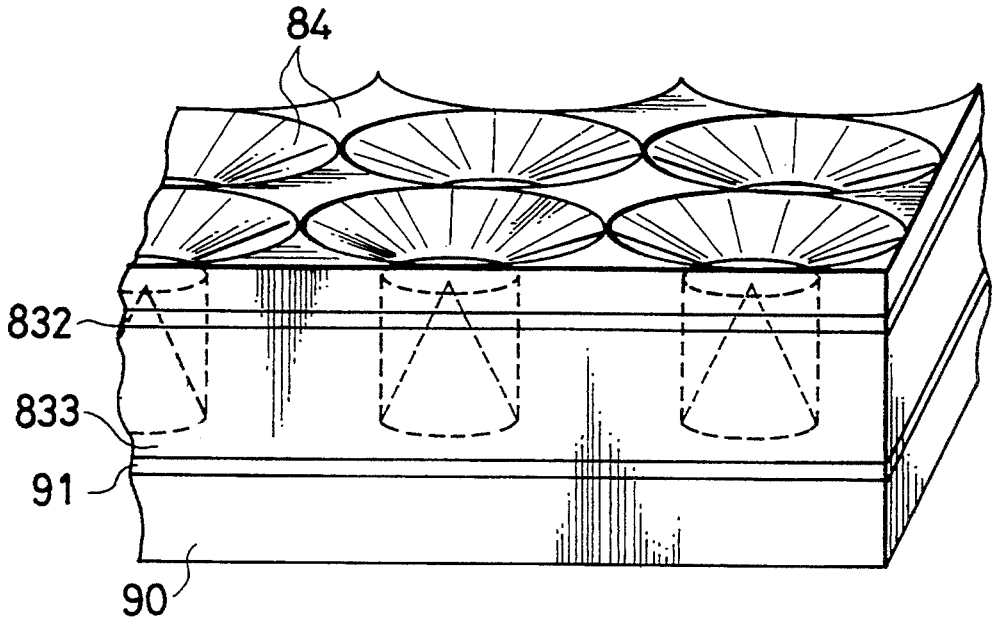
FIG. 12 is a perspective view showing the flat panel display device of FIG. 11.

FIG. 12 shows the cone-shaped surfaces of the light-reflecting film 84 of FIG. 11 in detail. There are provided with a plurality of cone-shaped holes each having each of the cone-shaped surfaces of the film 84. The light-reflecting film 84 is also provided with flat surfaces connected with the cone-shaped surfaces.

Figure 13:
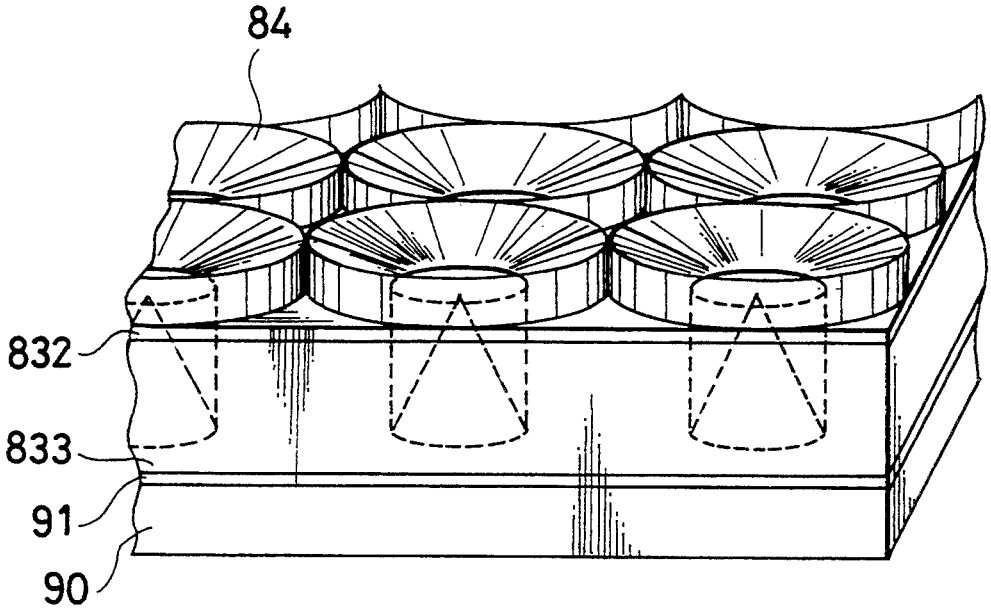
FIG. 13 is a perspective view showing a flat panel display device according to another embodiment.

FIG. 13 shows another example of the cone-shaped surfaces of the light-reflecting film 84 of FIG. 11. A plurality of cylindrical bodies composed of the conical base and light-reflecting film 84 having the cone-shaped surface are disposed in a matrix form on the gate electrode 832

In FIG. 5*e*, item 231*a* is a Mo layer laminated on the resist 28.

In FIG. 6*b*, item 29 is a resist layer after patterning, item 24 is an Ag layer after the hole 30 is formed.

In FIG. 6*c*, item 29*a* is a resist layer after patterning.

In FIG. 7, item 40 is a face plate, item 41 is an anode electrode layer, 42 is a fluorescent layer, item 431 is a cone-shaped cold cathodes, item 433 is an electric insulating layer, item 50 is a back-supporting plate and item 51 is a coldcathode electrode.

In FIG. 10, item 60 is a face plate, item 61 is an anode electrode layer, item 62 is a fluorescent layer, item 70 is a back-supporting plate, and item 71 is a coldcathode electrode.

In FIG. 11, item 80 is a face plate, item 81 is an anode electrode layer, item 82 is a fluorescent layer, item 831 is a cone-shaped cold cathodes, item 833 is an electric insulating layer, item 90 is a back-supporting plate, item 91 is a cold-cathode electrode.

In FIG. 12, item 90 is a back-supporting plate, item 91 is a cold-cathode electrode and item 833 is an electric insulating layer.

FIG. 13, item 90 is a back-supporting plate, item 91 is a cold-cathode electrode and item 833 is an electric insulating layer.

Many widely different embodiments of the present invention may be constructed without departing from the spirit and scope of the present invention. It should be understood that the present invention. It should be understood that the present invention is not limited to the specific embodiments described in the specification, except as defined in the appended claims.

What is claimed is:

1. A flat panel display comprising:

an anode electrode having a viewer-side surface and an electron-receiving-side surface;

a cathode electrode opposite to said anode electrode through a space, having a plurality of cold cathodes each emitting an electron to said electron-receiving-side surface of said anode electrode;

a gate electrode for triggering said emission of said electron from each of said cold cathodes;

an insulating layer sandwiched between said cathode electrode and said gate electrode for electrically insulating said cathode electrode from said gate electrode;

a fluorescent layer formed on said electron-receiving-side surface of said anode electrode for generating light by a collision of said electron emitted from each of said cold cathodes; and a light-reflecting layer formed on or above said gate electrode for reflecting said light emitted from said fluorescent layer to said viewer side surface of said anode electrode through said fluorescent layer and said anode electrode.

2. A flat panel display according to claim 1, wherein said insulating layer has a plurality of holes formed so as to penetrate through at least said insulating layer and said gate electrode, and each of said cold cathodes being disposed on said cathode electrode as a bottom of each of said holes.

3. A flat panel display according to claim 2, wherein said light-reflecting layer has a plurality of sloped portions so as to reflect said light at an optimum angle.

4. A flat panel display according to claim 3, wherein each of said sloped portions includes a cone-shaped surface sloped down toward said hole in which said cold cathode is disposed.

5. A flat panel display according to any one of claims 1 to 4, wherein said light-reflecting layer is composed of at least one or more metallic film and a dielectric film.

6. A flat panel display according to any one of claims 1 to 4, wherein said light-reflecting layer is composed of two or more dielectric films having respective indexes of refraction.

7. A flat panel display according to claim 4, wherein a first film of $SiO_2$, a second film of $TiO_2$ and a third film of $SiO_2$ are laminated on said sate electrode.

* * * * *